US006659309B2

(12) United States Patent
Friedman

(10) Patent No.: US 6,659,309 B2
(45) Date of Patent: Dec. 9, 2003

(54) PORTION CONTROL DISPENSER

(75) Inventor: Mitchell A. Friedman, Randallstown, MD (US)

(73) Assignee: International Dispensing Corporation, Millersville, MD (US)

( * ) Notice: Subject to any disclaimer, the term of this patent is extended or adjusted under 35 U.S.C. 154(b) by 0 days.

(21) Appl. No.: 10/309,506

(22) Filed: Dec. 4, 2002

(65) Prior Publication Data

US 2003/0102327 A1 Jun. 5, 2003

Related U.S. Application Data

(60) Provisional application No. 60/338,776, filed on Dec. 5, 2001.

(51) Int. Cl.[7] ..... B65D 35/28

(52) U.S. Cl. ..... 222/97; 222/102; 222/252; 222/256

(58) Field of Search ..... 222/101, 102, 222/97, 252, 256

(56) References Cited

U.S. PATENT DOCUMENTS

| | | | | | |
|---|---|---|---|---|---|
| 2,881,954 A | * | 4/1959 | Kirkpatrick et al. | ..... | 222/102 |
| 3,151,616 A | | 7/1962 | Selfon | ..... | 128/214 |
| 3,198,385 A | * | 8/1965 | Maxwell | ..... | 222/102 |
| 3,252,624 A | * | 5/1966 | Watson, Jr. | ..... | 222/102 |
| 3,738,533 A | | 6/1973 | Bertrand | ..... | 222/102 |
| 4,044,764 A | | 8/1977 | Szabo et al. | ..... | 128/214 F |
| 4,381,006 A | | 4/1983 | Genese | ..... | 128/218 A |
| 4,755,172 A | | 7/1988 | Baldwin | ..... | 604/131 |
| 4,850,971 A | | 7/1989 | Colvin | ..... | 604/134 |
| 4,895,557 A | | 1/1990 | Moise et al. | ..... | 600/16 |
| 5,490,613 A | | 2/1996 | Taylor et al. | ..... | 222/102 |
| 5,765,724 A | * | 6/1998 | Amberg et al. | ..... | 222/1 |
| 6,056,158 A | * | 5/2000 | Rossetti et al. | ..... | 222/95 |
| 6,089,405 A | | 7/2000 | Schmitt | ..... | 222/102 |

* cited by examiner

*Primary Examiner*—Kenneth Bomberg
(74) *Attorney, Agent, or Firm*—Whiteford Taylor & Preston LLP; Gregory M. Stone; Jeffrey C. Maynard

(57) ABSTRACT

A portion control dispensing apparatus for dispensing precise portions of a product in a tightly controlled manner that minimizes waste caused by residual product left undispensed in a container. The device provides a dispenser for fluid products stored in a flexible container, enabling a portion control pump combined with an extrusion apparatus to squeeze the flexible container, thus continuously directing all remaining product in the container towards the dispensing end. A portion control pump removes product from the container by peristaltic action. A preferred embodiment of the apparatus comprises a frame with an upwardly spring biased carriage configured to removably hold a flexible container that holds product to be dispensed. A pair of rollers is preferably situated at the top of the frame and is positioned such that the carriage will pull the flexible container upward between the rollers as product is dispensed from the container.

24 Claims, 14 Drawing Sheets

SECTION A-A
ENLARGED

PORTION CONTROL DISPENSER

CROSS REFERENCE TO RELATED APPLICATION

This application is based upon and claims benefit of and co-owned U.S. Provisional Patent Application Ser. No. 60/338,776 entitled "Portion Control Pump", filed in the U.S. Patent and Trademark Office on Dec. 5, 2001, by the inventor herein, the specification of which is incorporated herein by reference.

BACKGROUND OF THE INVENTION

1. Field of the Invention

The invention disclosed herein relates generally to dispensing systems, and more particularly to a dispensing system for dispensing portions of a product in a tightly controlled manner which minimizes waste caused by residual product left undispensed in a container.

2. Background of the Prior Art

A wide variety of viscous fluids, including personal care products (e.g., tooth paste, shaving cream, cosmetics, and shampoo), food products (e.g., condiments, salad dressings, and the like), as well as industrial products (e.g., cleaning fluids, lubricating oils and greases) are provided in flexible containers, such as sealed plastic bags and light collapsible tubes. Even health care products, such as blood and medications, may be stored in and dispensed from a flexible or collapsible bag.

When such products are provided in bulk, it is impractical to squeeze the container by hand in order to discharge the required quantity of its contents. Numerous devices provided in the prior art have been employed to dispense the contents of such flexible containers. Many such devices mechanically squeeze the container to extrude the contents out through a dispensing outlet. Generally, such devices have provided mechanical means such as springs or ratchets to assist in extruding the fluid from a flexible or collapsible bag. Other dispensers have typically provided arrangement of a container so that the fluid may flow from the container under the influence of gravity. In the case of blood transfusions, dispensing of fluid is typically regulated by a valve whose flow rate depends upon the amount of time desired to empty the container. For example, U.S. Pat. No. 4,850,971 to Colvin discloses an infusion pump having a linear roller driven by constant force springs to extrude blood from a flexible container by rolling an end of the container on the linear roller so as to direct the fluid toward the dispensing end of the container. Flow is regulated through use of needles of varying size on the dispensing line.

U.S. Pat. No. 4,044,764 to Szabo et al. discloses a fluid infusion apparatus having a spring motor which pulls a flexible container through a pair of rollers so as to direct fluid in the container towards the dispensing end of the container. A speed control clock motor engages a portion of the carriage carrying the container so as to resist the pull of the spring motor and provide timing control for dispensing of fluid from the container.

U.S. Pat. No. 3,151,616 to Selfon discloses a transfusion apparatus in which a flexible bag containing blood, plasma, or the like is progressively flattened as a pair of rack-gear-mounted rollers travels over the bag, directing its contents towards the dispensing end of the apparatus.

For other products, the portion of product dispensed is typically regulated by limiting the amount by which the container is compressed. For example, U.S. Pat. No. 3,738,533 to Bertrand discloses a motorized collapsible tube dispenser in which a pair of motor-driven rollers are driven downwards over a vertically suspended tube so as to direct the contents of the tube towards the dispensing end.

U.S. Pat. No. 6,089,405 to Schmitt discloses a manually operable dispenser for a tube containing cream or paste (e.g., toothpaste) having a housing with an opening at its base for receiving the dispensing end of the tube, and a pair of rollers which are translated up and down in the base so as to direct material within the tube toward the dispensing end.

While these dispensers have been generally satisfactory for their intended uses, there has been found to remain a need for an apparatus to control the dispensing of fluid products from such flexible containers in order to facilitate the dispensing of fluid products in a simple and effective manner while minimizing waste of product.

SUMMARY OF THE INVENTION

The present invention provides a dispenser for fluid products stored in a flexible container, in which operation of a dispensing pump enables an extrusion assembly to squeeze the flexible container, thus continuously directing all remaining product in the container towards the dispensing end. The dispensing pump preferably removes product from the container by positive displacement action, and more preferably by peristaltic action. A preferred embodiment of the apparatus of the invention comprises a frame with an upwardly spring biased carriage configured to removably hold a flexible container that holds product to be dispensed. An extrusion assembly preferably in the form of one or more rollers is situated at the top of the frame and is positioned such that the carriage will pull the flexible container upward past such one or more rollers as product is dispensed from the container.

The portion control dispenser described herein thus enables dispensing portions of a product in a tightly controlled manner, which in turn minimizes waste caused by residual product left undispensed in a container. A frame preferably provides support for a flexible container, and includes a moveable carriage having a drive assembly, a guide assembly, and a flexible bag mount, preferably in the form of a traction bar assembly. The frame also supports an extrusion assembly, preferably in the form of one or more rollers, for directing product towards the dispensing end of the container, and a dispensing pump for dispensing a controlled portion of product from the container. Such construction enables the flexible container to remain completely closed except for its outlet so that the product remains unexposed to the atmosphere until it exits from the dispensing pump.

It is generally contemplated that the dispenser can be employed in a variety of settings such as food service stores or institutions, other commercial settings and even for personal use in homes and the like.

In other applications, it may be important that the product be prevented from contacting the air or the environment at least until the product is properly dispensed.

Regardless of the setting, it is further contemplated that the product be initially stored in a flexible or collapsible container which can then be arranged in a dispenser operable for dispensing the product from the container in a simple and effective manner to assure delivery of a satisfactory amount of the product at a controlled rate of delivery.

It is further desirable that the dispenser be capable of dispensing the material only in response to operation by a user of a dispenser device.

The various features of novelty that characterize the invention will be pointed out with particularity in the claims of this application.

BRIEF DESCRIPTION OF THE DRAWINGS

The above and other features, aspects, and advantages of the present invention are considered in more detail, in relation to the following description of embodiments thereof shown in the accompanying drawings, in which.

DETAILED DESCRIPTION OF THE INVENTION

The invention summarized above and defined by the enumerated claims may be better understood by referring to the following description, which should be read in conjunction with the accompanying drawings in which like reference numbers are used for like parts. This description of an embodiment, set out below to enable one to build and use an implementation of the invention, is not intended to limit the enumerated claims, but to serve as a particular example thereof. Those skilled in the art should appreciate that they may readily use the conception and specific embodiments disclosed as a basis for modifying or designing other methods and systems for carrying out the same purposes of the present invention. Those skilled in the art should also realize that such equivalent assemblies do not depart from the spirit and scope of the invention in its broadest form.

Figure 1:
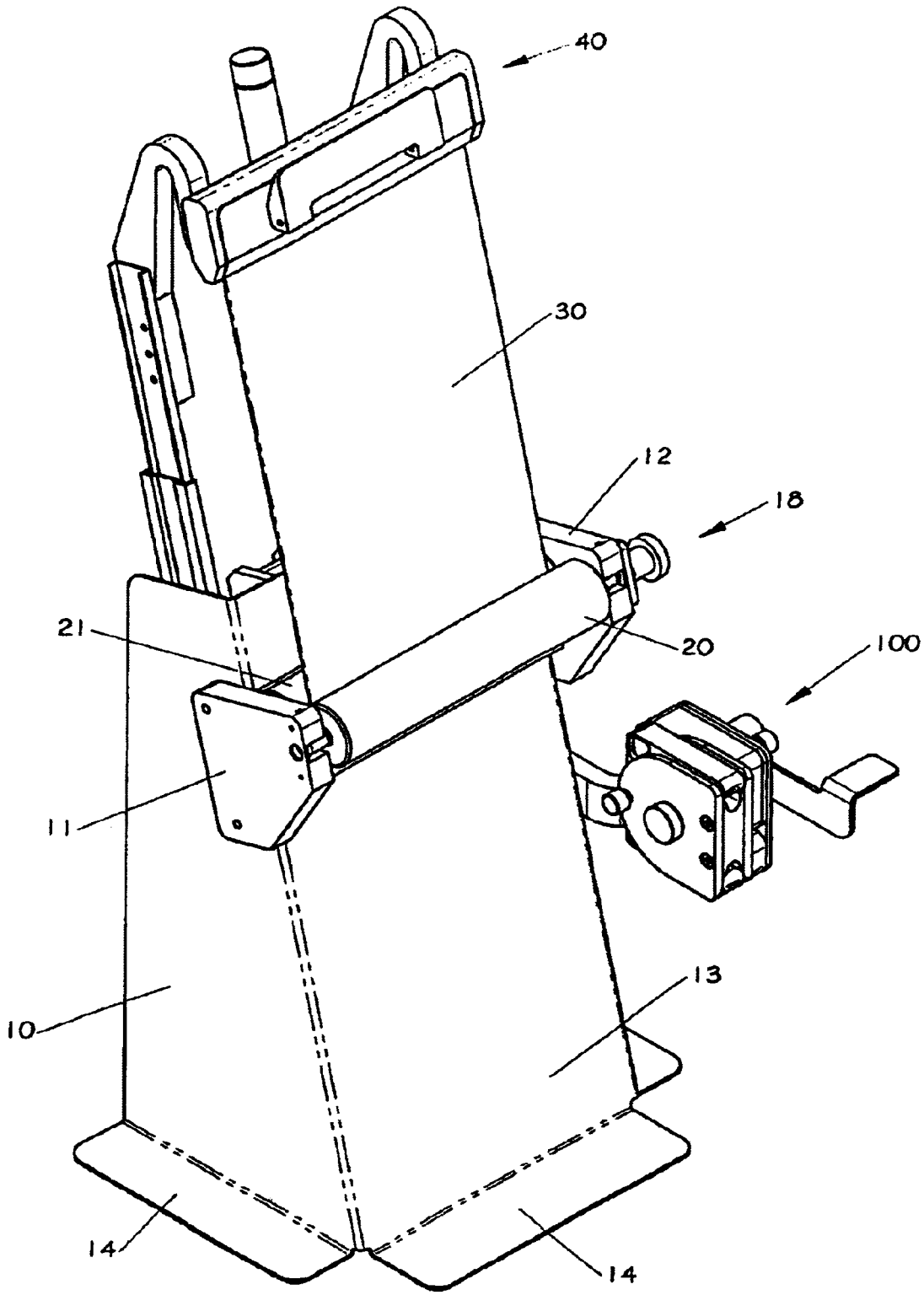
FIG. 1 is a side perspective view of a portion control dispenser according to one preferred embodiment of the instant invention.
Figure 2:
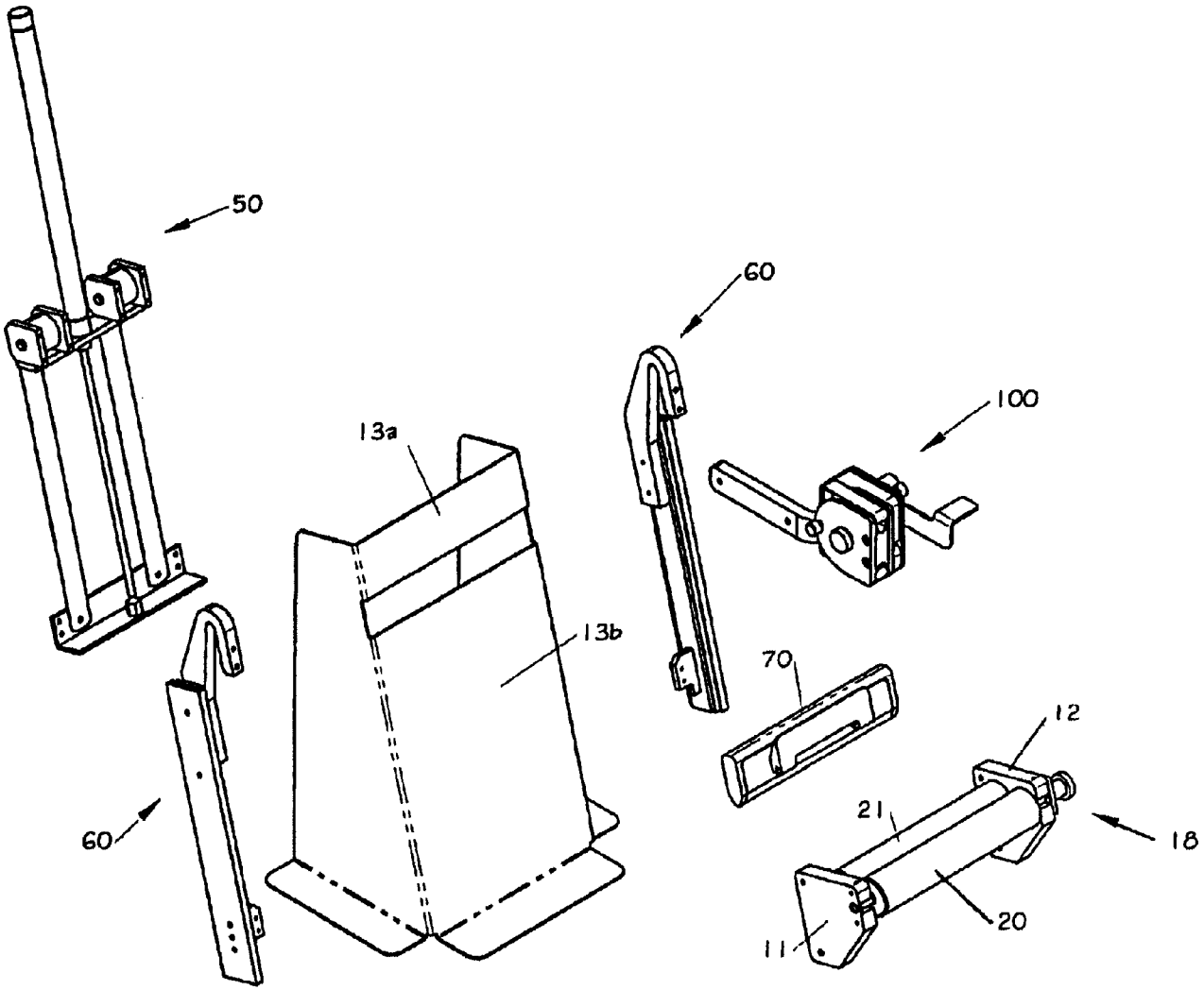
FIG. 2 is an exploded view of the portion control dispenser of FIG. 1.

As shown in the side, perspective view of FIG. 1, a first embodiment of the portion control dispenser of the instant invention comprises a rigid, upright frame 10 to which a carriage 40 is slidably connected for generally vertical displacement with respect to frame 10. Carriage 40 is configured to removably mount a flexible container 30 whose contents are to be dispensed. Frame 10 is provided adjacent its upper end with an extrusion assembly 18. In the particular embodiment depicted in FIG. 1, extrusion assembly 18 comprises arms 11 and 12 which rotatably mount rollers 20 and 21 (FIG. 2) so as to enable carriage 40 to pull container 30 between the rollers during its upward travel. A dispensing pump 100 is preferably mounted to frame 10 and, during operation, is in fluid communication with the interior of container 30 via tubing (not shown) for dispensing the contents of container 30. Dispensing pump 100 is preferably provided in the form of a positive displacement pump, and more preferably in the form of a peristaltic pump.

The portion control dispenser of the instant invention is configured to support a wide array of containers 30 having a generally flexible exterior, including flexible bags, flexible pouches, and aseptic packages commonly used for holding food products.

Frame 10 is preferably formed of a rigid material, such as steel or aluminum, and is configured to mount the dispensing assembly in a generally vertical orientation, thus benefiting from the force of gravity which aids in the dispensing process, and providing the smallest possible footprint for such a dispensing apparatus. Frame 10 may be provided feet 14 extending outwardly from the bottom of each wall of frame 10. As shown in the exploded view of FIG. 2, frame 10 preferably has a slotted front face defining an upper wall portion 13*a* and a lower wall portion 13*b*, and a generally horizontal opening defined therebetween. Upper wall portion 13*a* and lower wall portion 13*b* preferably lie within the same plane, and are optionally situated at a slight angle from a vertical plane so as to aid in positioning container 30 within the dispensing apparatus.

As mentioned above, carriage assembly 40 is configured to draw container 30 upward through rollers 20 and 21 as product is dispensed from container 30. As shown in the exploded view of FIG. 2, carriage assembly 40 preferably comprises drive assembly 50, side guide assemblies 60, and a mount 70 configured to removably hold an end of a flexible container. In the embodiment of FIG. 1, mount 70 is preferably provided in the form of a traction bar assembly.

Figure 3:
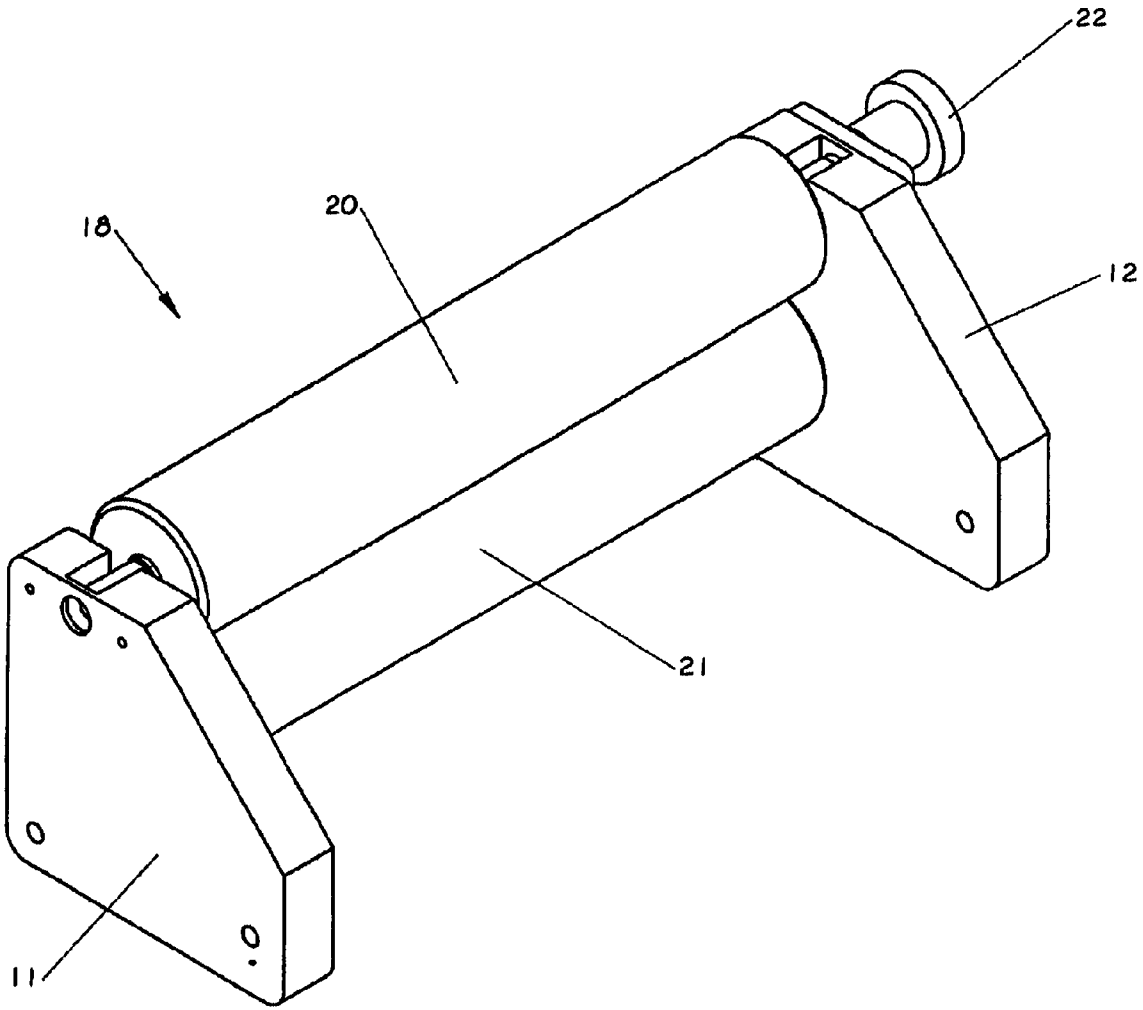
FIG. 3 is a perspective view of a press roller assembly of the portion control dispenser of FIG. 1.
Figure 4:
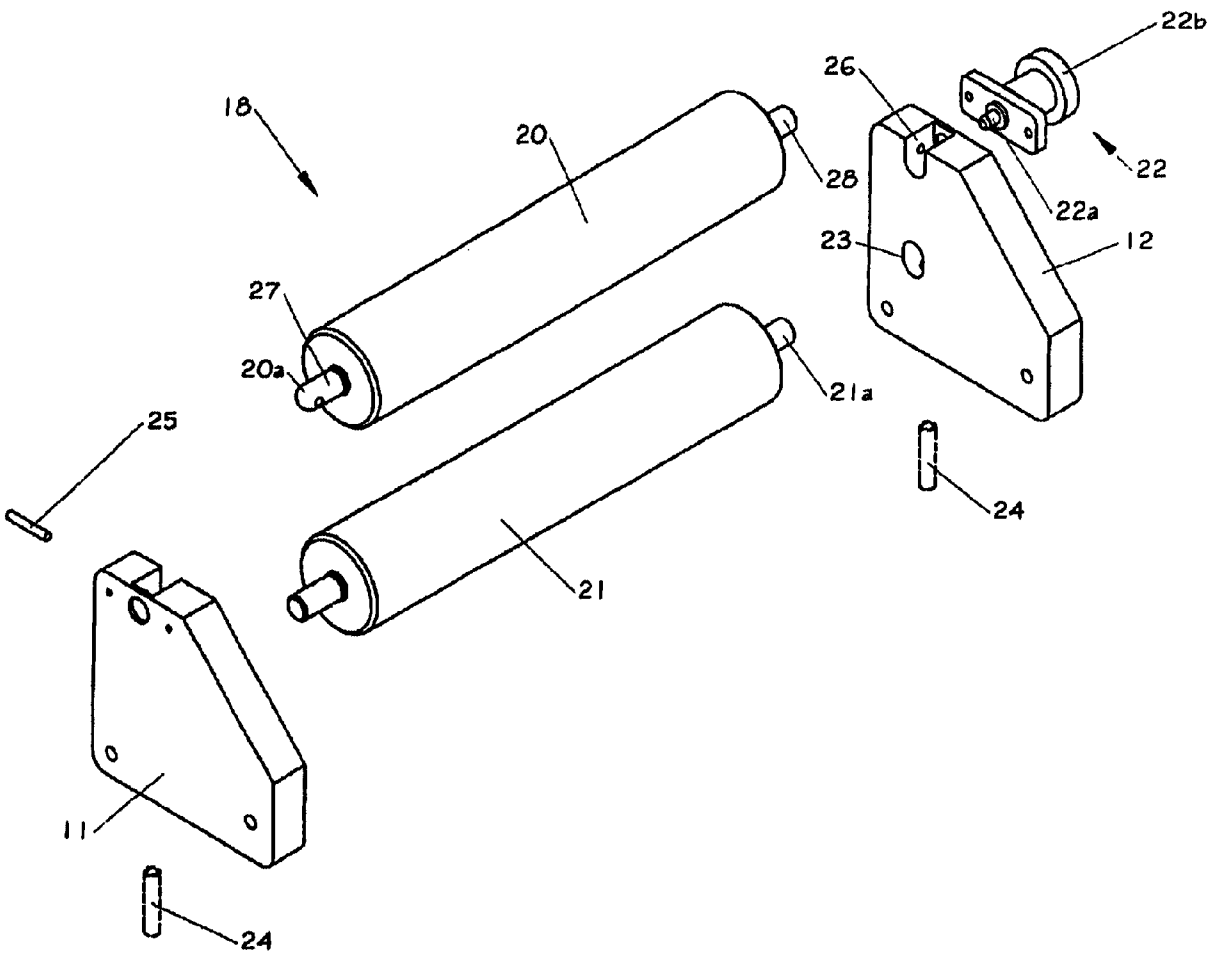
FIG. 4 is an exploded view of the press roller assembly of FIG. 3.

Referring to FIGS. 3 and 4, extrusion assembly 18 comprises arms 11 and 12 that may be affixed to sidewalls of frame 10 using screws, bolts, or similarly configured fasteners. Rotatably mounted between arms 11 and 12 are exterior roller 20 and interior roller 21. As shown more particularly in the exploded view of FIG. 4, interior roller 21 is provided a shaft 21*a* (about which roller 21 may freely rotate) which is inserted into boreholes 23 on the interior of each of arms 11 and 12 so as to rotatably mount roller 21 between arms 11 and 12. Interior roller 21 is oriented to fit generally within the horizontal opening between upper wall portion 13*a* and lower wall portion 13*b* so as to enable unobstructed rotation of interior roller 21. Spring members 24, such as coil springs, are held within a socket in the rear wall of each of arms 11 and 12 such that one end of spring members 24 engage top wall portion 13*a* of the front of frame 10, while the opposite end of spring members 24 engage shaft 21*a*. In this way, interior roller 21*a* is spring biased toward exterior roller 20.

Exterior roller 20 is also provided a shaft 20*a* about which roller 20 may freely rotate, the shaft having a first end 27 and a second end 28. First end 27 of shaft 20*a* is preferably provided a borehole configured to receive a dowel 25. Dowel 25 is inserted through the top wall of arm 11 until it passes through the borehole in first end 27, thus preventing separation of roller 20 from arm 11, while enabling roller 20 to pivot about dowel 25 away from interior roller 21. Such pivoting movement enables easy placement of a container 30 into the dispensing apparatus. The second end 28 of shaft 20*a* is inserted into a recess 26 in arm 12. Extending through the exterior wall of arm 12 and into recess 26 is a plunger 22 provided with a detent mechanism 22*a* at its forward end. Second end 28 of shaft 20*a* is preferably hollow so that it may receive detent mechanism 22*a* therein, thus preventing separation of the second end 28 of shaft 20*a* from arm 12. However, by pulling actuating knob 22*b* of plunger 22 outward, detent mechanism 22*a* may be withdrawn from the second end 28 of shaft 20*a*, thus enabling the release of second end 28 from arm 12 as roller 20 is rotated about dowel 25 at the first end 27.

Figure 5:
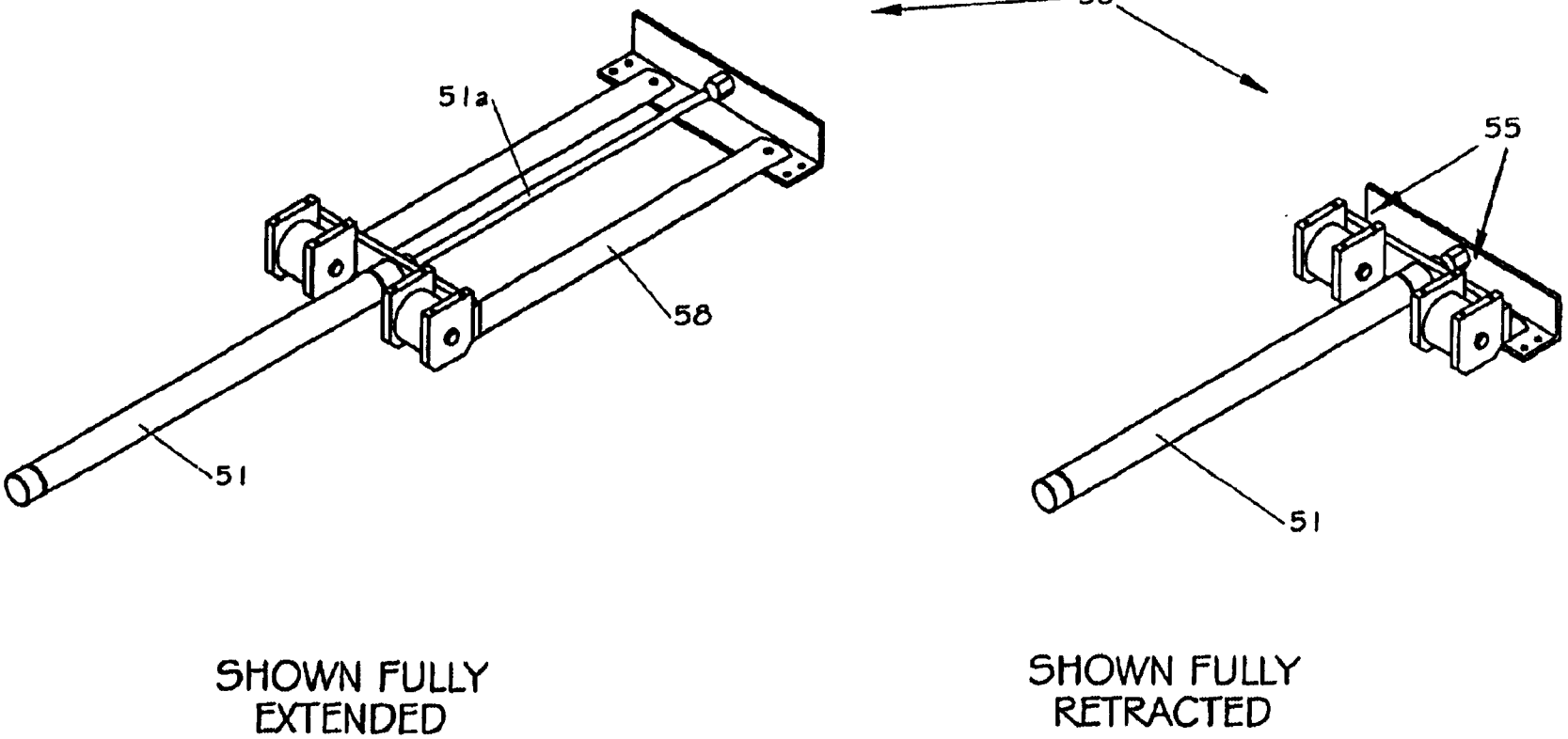
FIG. 5 is a perspective view of a drive assembly of the portion control dispenser of FIG. 1 shown in both a fully extended and a fully retracted position.
Figure 6:
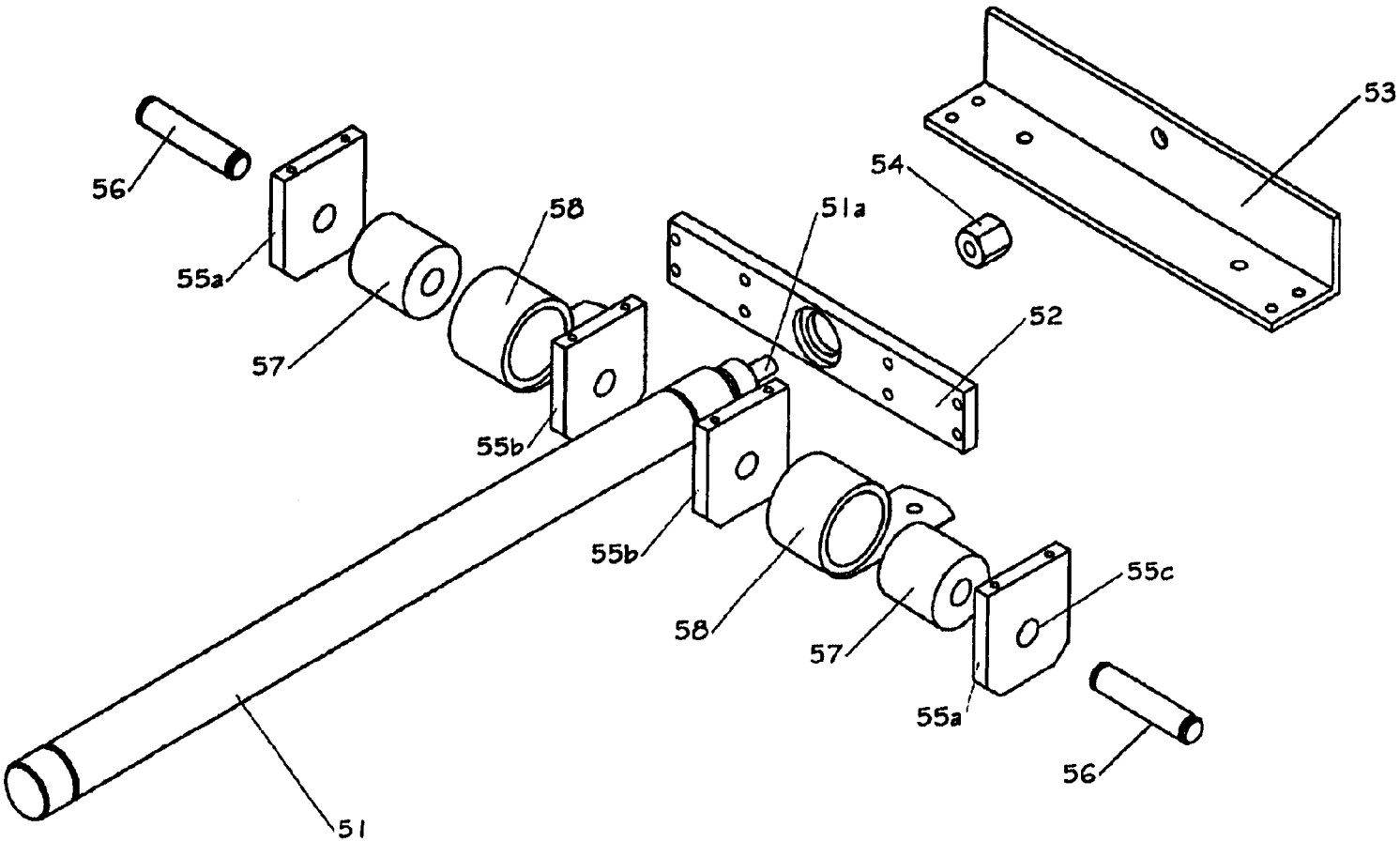
FIG. 6 is an exploded view of the drive assembly of FIG. 5.

As shown in FIG. 5, drive assembly 50 is operable to move from a fully extended position when a new container 30 is inserted into the dispensing apparatus, to a fully retracted position in which all product has been dispensed from container 30. With reference to both FIGS. 5 and 6, drive assembly 50 comprises a damping cylinder 51 having an outwardly extensible rod 51*a* whose movement is restricted by a damping medium, such as oil, air, or any other compressible medium as is well known in the art, within cylinder 51. The base of cylinder 51 is attached to a bracket 52, preferably by means of a threaded portion at the base of cylinder 51 and an opening extending through bracket 52 having a matching receiving threaded portion therein. Rod 51*a* extends through bracket 52 and is affixed to a drive beam 53, preferably through use of a threaded coupler 54 or other connection mechanism as is well known in the art. A pair of motor supports 55 are affixed to bracket 52 on opposite sides of cylinder 51, such as by screws, bolts, or similarly configured fasteners. Each motor support 55 comprises sidewalls 55*a* and 55*b*. A front side of sidewalls 55*a* and 55*b* is provided apertures such that each motor support may be affixed to the back surface of the upper portion 13*a* of the front face of frame 10. Extending through each sidewall 55*a* and 55*b* is a borehole 55*c*, through which a motor shaft 56 is mounted. Rotatably mounted on each motor shaft 56 is a motor drum 57, each of which motor drum in turn mounts a constant force spring motor 58. In an unwound configuration, each spring motor 58 biases drive beam 53 towards bracket 52, thus having a tendency to draw a container 30 mounted to drive assembly 50 upward through rollers 20 and 21. However, spring motors 58 are selected such that the force to draw a filled container 30 through roller assembly 18 exceeds the force applied from spring motors 58. Thus, any volume of container 30 containing undispensed material will always rest below rollers 20 and 21, and only when additional product is dispensed from the bottom of container 30 through dispensing pump 100 will carriage assembly 40 be able to further pull container 30 upward through roller assembly 18. Of course, as additional material is dispensed from container 30, and container 30 is thus pulled further upward through roller assembly 18, any residual material within container 30 is directed by the force of rollers 20 and 21 downwards, thus significantly reducing the amount of wasted material that might be realized by prior art dispensing apparatus.

In order that upward movement of drive assembly 50 may result in drawing container 30 through roller assembly 18, a pair of guide assemblies 60 is affixed to each side of drive beam 53, which guide assemblies in turn are connected at their upper ends to traction bar assembly 70.

Figure 7:
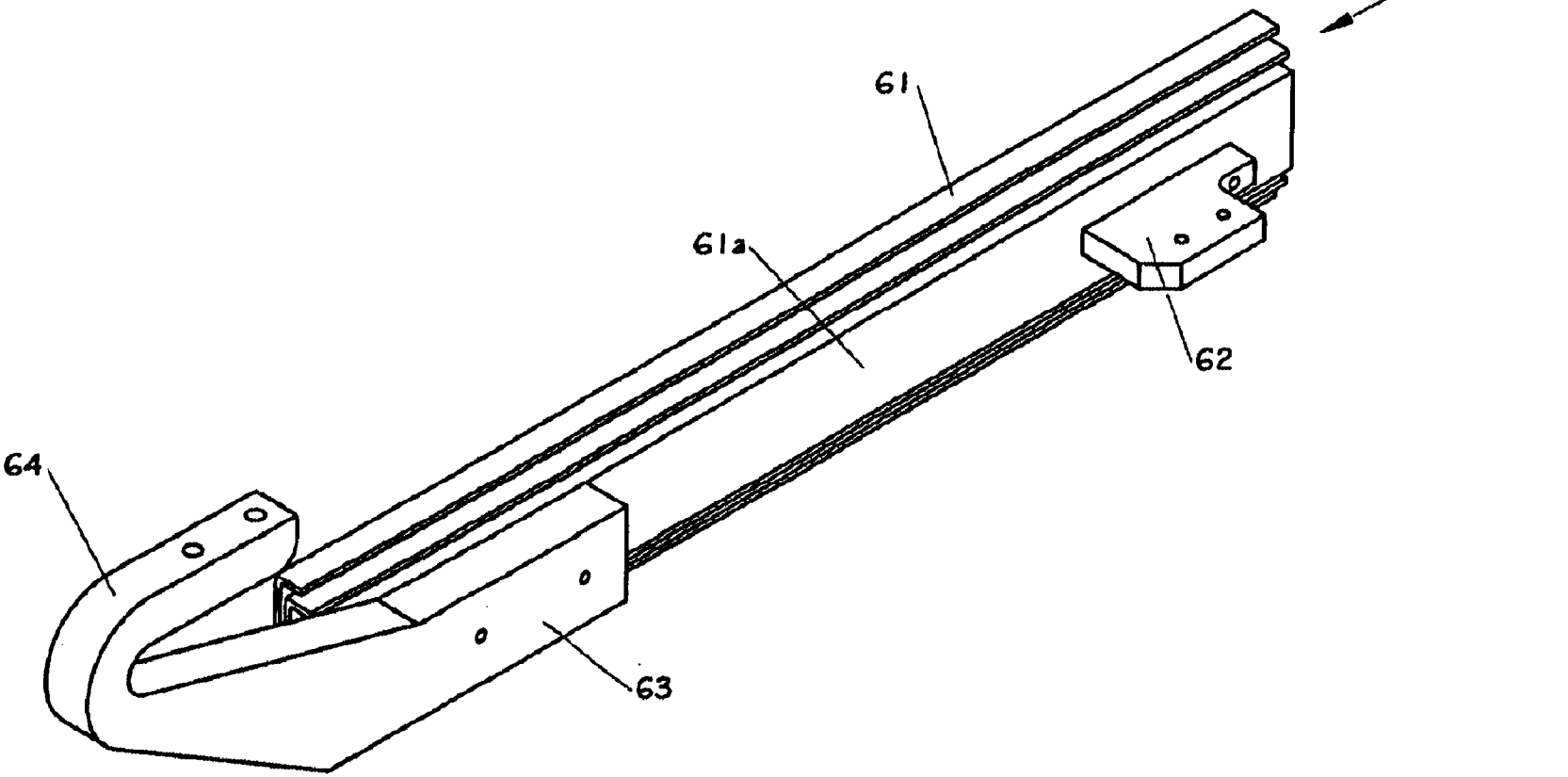
FIG. 7 is a perspective view of a guide assembly of the portion control dispenser of FIG. 1.

As shown in the perspective view of FIG. 7, each guide assembly 60 preferably comprises a telescoping rail assembly 61 enabling a central panel 61*a* of the rail assembly 61 to extend outward in a direction parallel to the major axis of rail assembly 61. Telescoping rail assembly 61 is of conventional configuration, the construction and operation of which is well known to those of ordinary skill in the art. Affixed to the bottom of each central panel 61*a* is a connector bracket 62. Each connector bracket 62 is preferably provided one or more apertures enabling connector brackets 62 to be attached to opposite ends of drive beam 53, while the outermost portion of telescoping rail assembly 61 is affixed to the interior side walls of frame 10. Thus, retraction of drive assembly 50 toward the fully retracted position (shown in FIG. 5) will likewise upwardly extend central panel 61*a* of telescoping rail assembly 61. Affixed to the upper end of each central panel 61*a* is a traction bar assembly bracket 63. Each traction bar assembly bracket 63 has a looped upper arm 64, the terminal end of which is preferably provided with apertures enabling each traction bar assembly bracket 63 to be affixed to traction bar assembly 70 via screws, bolts, or other similarly configured connectors. The loop in upper arms 64 enables each guide assembly 60 to be mounted on the interior walls of frame 10, while traction bar assembly 70 is positioned outside of frame 10, thus enabling easy insertion and removal of a container 30.

Figure 8:
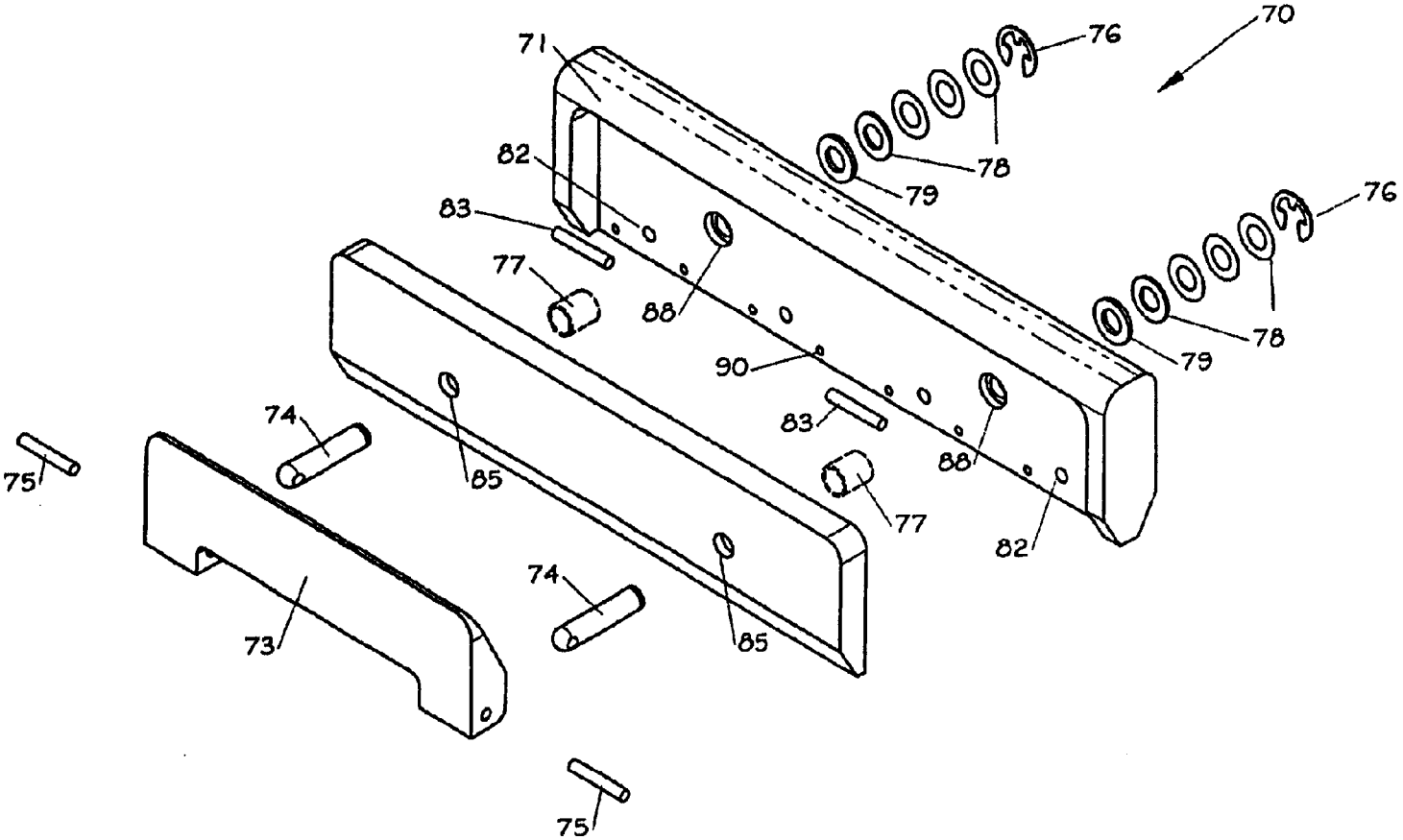
FIG. 8 is an exploded view of a traction bar assembly of the portion control dispenser of FIG. 1.

As shown more particularly in the exploded view of FIG. 8, traction bar assembly 70 preferably includes a fixed jaw 71 and movable jaw 72 that together form a clamping mechanism for holding container 30. Fixed jaw 71 is preferably provided apertures enabling fixed attachment of fixed jaw 71 to the front portions of looped upper arms 64. A cam lever 73 is provided which enables movable jaw 72 to be moved from a locked position, in which movable jaw 72 is held tightly against fixed jaw 71, to an open position, in which movable jaw 72 is held a distance away from fixed jaw 71, thus enabling insertion of the upper portion of a container 30 between fixed jaw 71 and moveable jaw 72. With reference to FIG. 8 and the front and cross-sectional views of FIG. 9, studs 74 extend into the rear face of cam lever 73. Each stud 74 is provided a borehole at one end configured to receive a dowel 75, which dowel 75 is positioned in boreholes in both cam lever 73 and studs 74, such that a pivotal connection is established between cam lever 73 and studs 74. The ends of studs 74 opposite the borehole are inserted through openings 85 extending through movable jaw 72 and openings 88 extending through fixed jaw 71, and a fastening device such as an e-clamp 76 is used to hold the free ends of studs 74 on the back side of fixed jaw 71. A plurality of spacers 78 and a wave spring 79 may optionally be provided on the free end of studs 74 between e-clamp 76 and the back face of fixed jaw 71. As particularly shown in the cross-sectional view of FIG. 9, fixed jaw 71 is preferably indented on its rear side such that the outermost end of stud 74 does not extend beyond the outermost rear surface of fixed jaw 71. This enables fixed jaw 71 to be flush mounted against the front faces of looped upper arms 64.

In operation, cam lever 73 is in a substantially vertical orientation when moveable jaw 72 is in a locked position. Cam lever 73 is rotated about dowel 75 to a substantially horizontal orientation to place moveable jaw 72 in an open position. Spring members 77, such as coil springs, surround each stud 74 between fixed jaw 71 and moveable jaw 72 and, when traction bar assembly 70 is fully closed, spring members 77 are compressed by each of fixed jaw 71 and movable jaw 72. Openings 85 and 88 are stepped such that spring members 77 can be partially recessed in fixed jaw 71 and moveable jaw 72 when traction bar assembly 70 is in the fully closed position, as shown in cross section FIG. 9. Likewise, when cam lever 73 is rotated to the open position, spring members 77 push moveable jaw 72 outward and away from the front face of fixed jaw 71 a small distance to enable insertion or removal of the top portion of a container 30 into the traction bar assembly 70.

Figure 9:
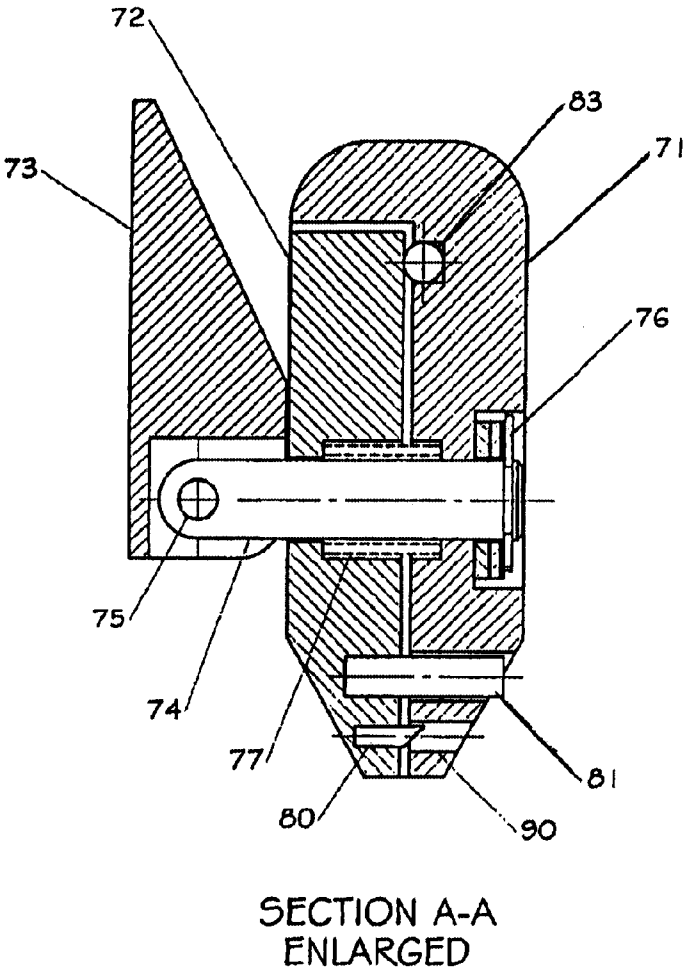
FIG. 9 is a front view and side, sectional view of the traction bar assembly of FIG. 8.
Figure 9:
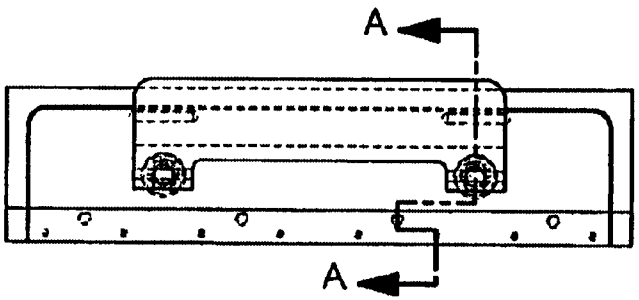
Figure 10:
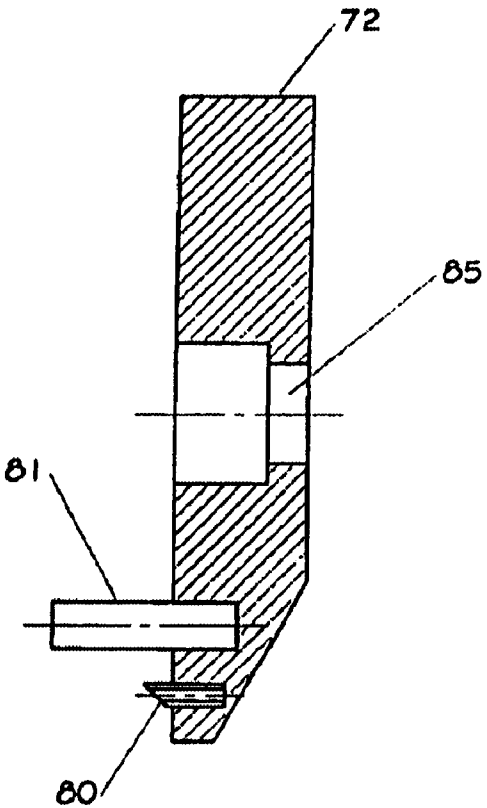
FIG. 10 is a rear view and side, sectional view of a movable jaw of the traction bar assembly of FIG. 8.
Figure 10:
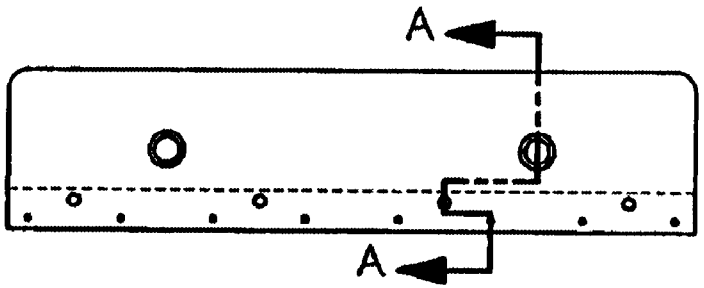

In order to aid in holding container 30 in place between fixed jaw 71 and movable jaw 72, and as shown more particularly in FIGS. 9 and 10, movable jaw 72 is preferably provided a plurality of pins 80 having a sharpened head configured to pierce a peripheral portion, preferably a sealing edge, of container 30. In addition to the clamping force provided between fixed jaw 71 and movable jaw 72, pins 80 engage pin holes 90 in the front face of fixed jaw 71 to further ensure that container 30 will not inadvertently dislodge from carriage assembly 40 as the container 30 is pulled through roller assembly 18. Positioning dowels 81 are also preferably provided extending outward from the rear face of movable jaw 72 and engaging boreholes 82 in the front face of fixed jaw 71 so as to guide the motion of movable jaw 72 when cam lever 73 is rotated to the open position and spring members 77 outwardly bias movable jaw 72. Further, a dowel 83 may optionally be provided between the top rear face of movable jaw 72 and the top front face of fixed jaw 71 so as to encourage slight rotation of movable jaw 72 about dowel 83 when movable jaw 72 is biased away from fixed jaw 71.

Figure 11:
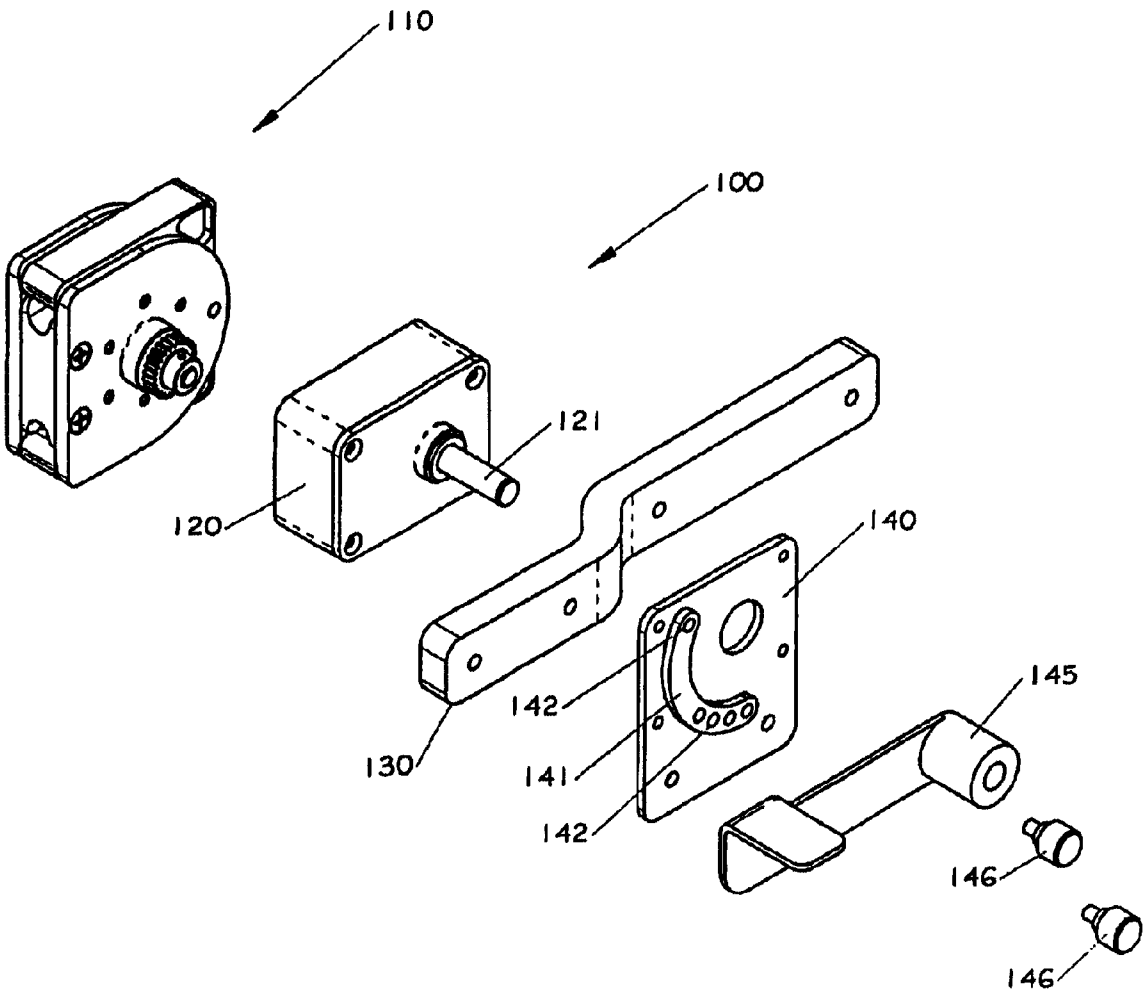
FIG. 11 is an exploded view of the peristaltic pump assembly of the portion control dispenser of FIG. 1.
Figure 12:
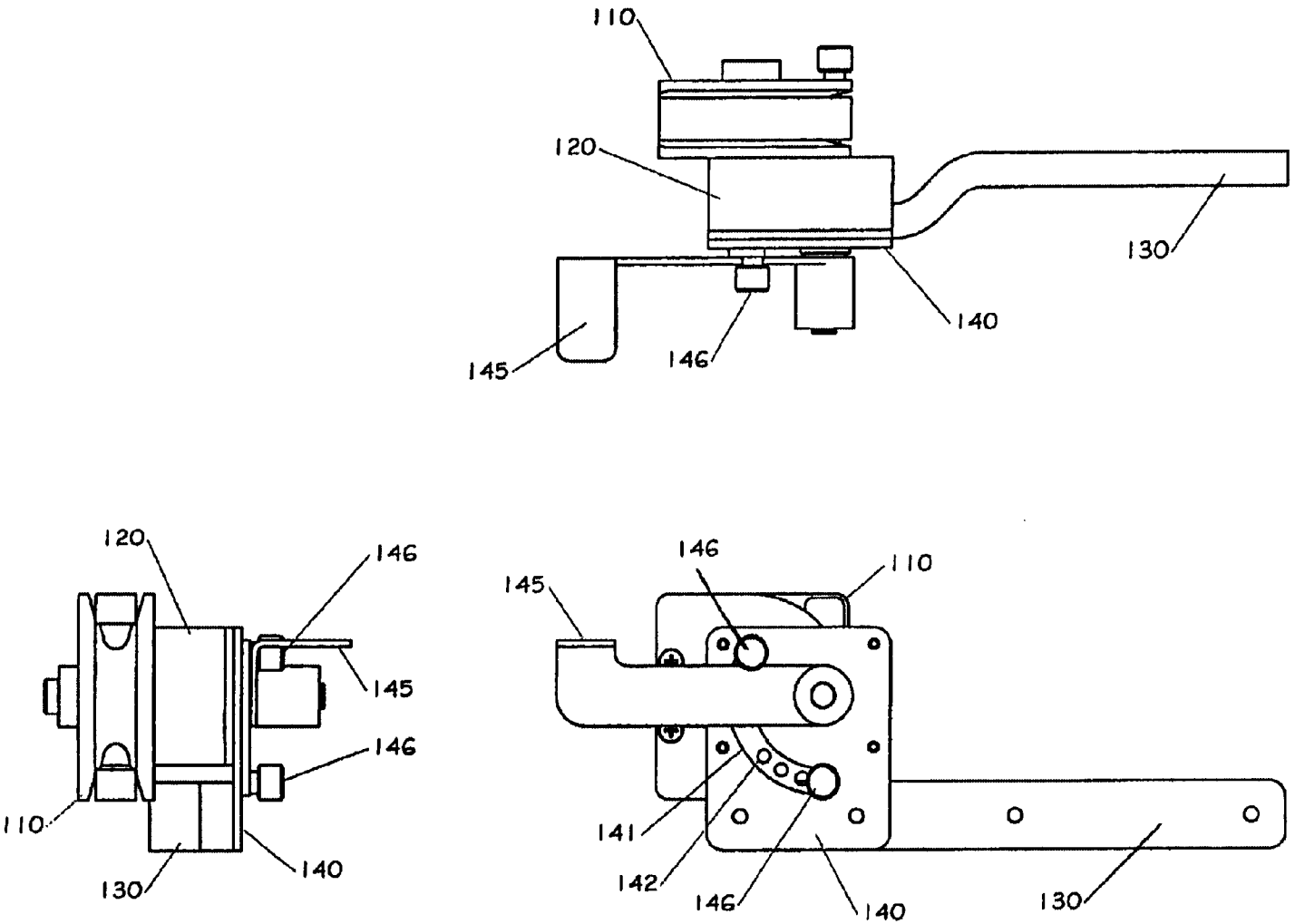
FIG. 12 is a front, side, and top view of the peristaltic pump assembly of FIG. 11.

As shown in the exploded perspective view of FIG. 11, a preferred dispensing pump 100 preferably comprises a peristaltic pump head assembly 110, a gear drive assembly 120, arm 130 for attaching pump assembly 100 to the outside wall of frame 10, a pump mount 140, a pump lever 145, and retaining pins 146. As shown more particularly in the front, side, and top views of FIG. 12, peristaltic pump head 110 is affixed to and operatively engaged with gear drive assembly 120, which in turn is operatively engaged with pump lever 145. Pump mount 140 is positioned between gear drive assembly 120 and pump lever 145, and has apertures extending through its bottom portion for attaching pump mount 140 to arm 130 via screws, bolts, or similarly configured connectors. Pump mount 140 is preferably provided an arcuate plate 141 having a series of openings therein configured to receive retaining pins 146. With pump lever 145 positioned between two retaining pins 146 attached to plate 141, the pump stroke may be adjusted to provide for dispensing only the requisite amount of material from container 30. Moreover, as multiple openings are provided in plate 141, such stroke may be varied simply by removing a retaining pin and replacing it in another opening which affords the proper stroke for the particular application.

It should be noted that dispensing pump 100 is thus particularly configured to dispense a predetermined volume of material from container 30 upon a single dispensing operation, e.g., a single manual operation of pump lever 145, with the length of the stroke determining the amount of material to be dispensed. Thus, for a given stroke, the apparatus of the instant invention will consistently dispense the fixed, predetermined volume of material for each dispensing operation.

Figure 13:
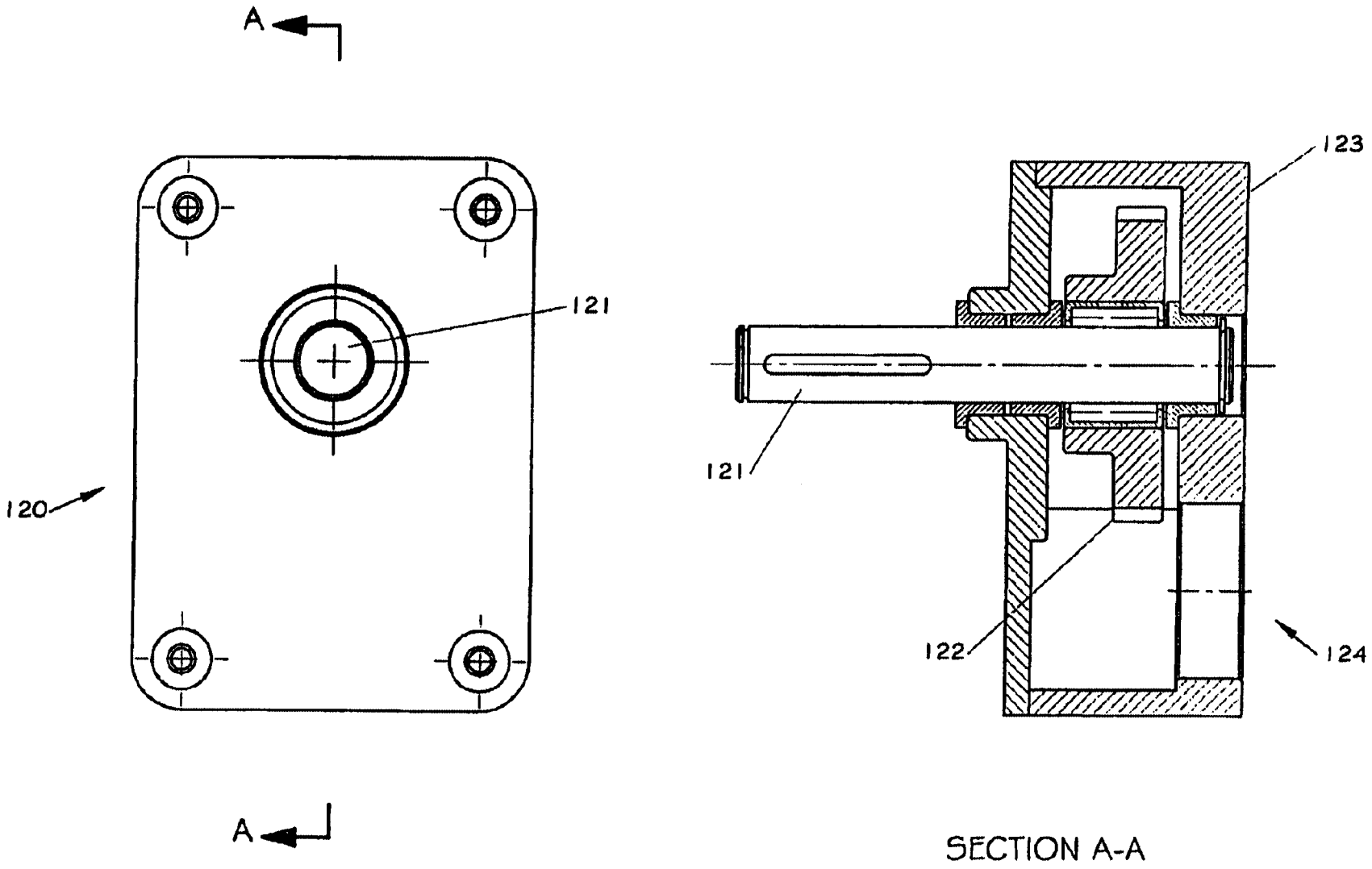
FIG. 13 is a front and side, sectional view of a gear drive assembly of the peristaltic pump assembly of FIG. 11.
Figure 14:
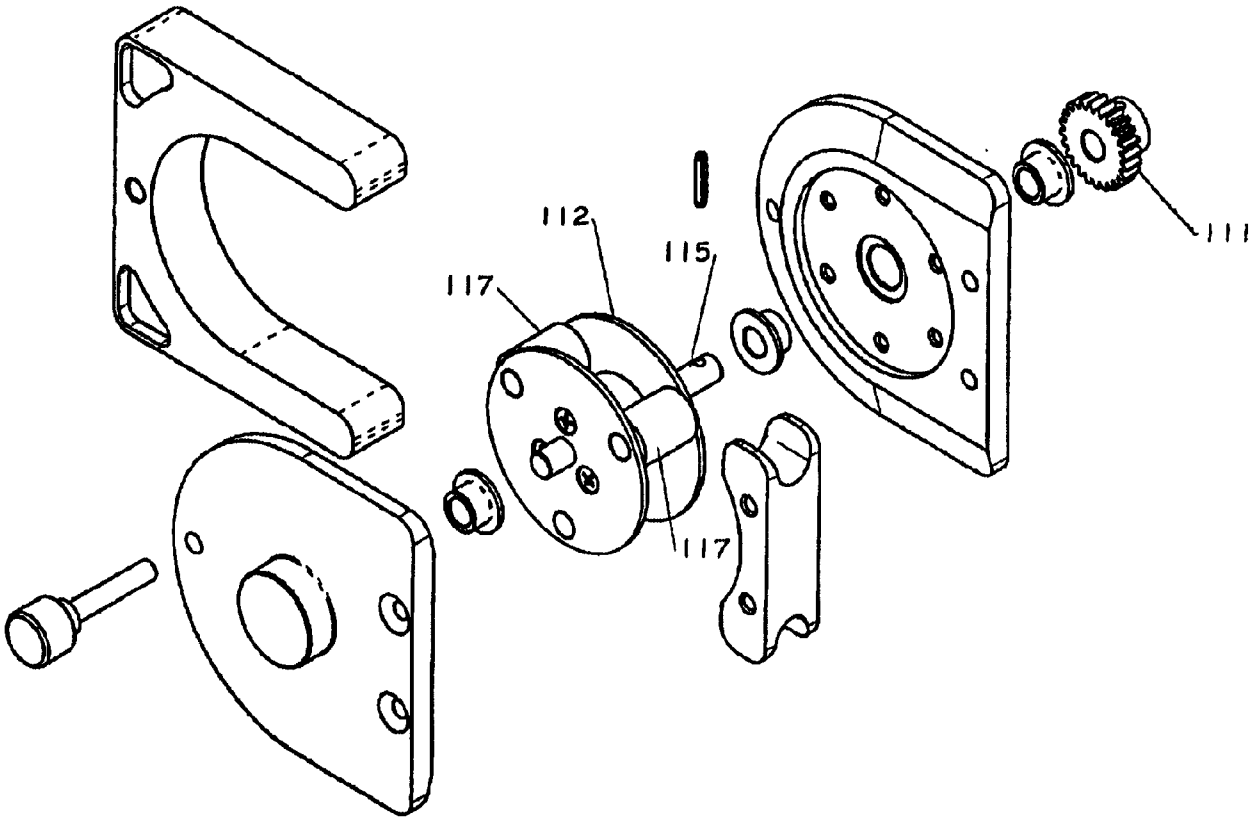
FIG. 14 is an exploded view of a pump head assembly of the peristaltic pump assembly of FIG. 11.

As shown more particularly in FIG. 13, gear drive assembly 120 comprises an input shaft 121 that receives torque transferred from pump lever 145 and directs the same to a pump gear 122 within gear drive housing 123. Housing 123 is preferably equipped with an opening 124 at the bottom of its rear side, which opening is adapted to receive a pump pinion 111 (FIG. 14) of pump head assembly 110, which pinion 111 operatively engages pump gear 122 so as to transfer torque to pump head assembly 110. As shown in the exploded view of FIG. 14, pump pinion 111 operatively engages the drive shaft 115 of roller assembly 112. Thus, it can be seen that rotation of pump lever 145 will ultimately cause the operation of roller assembly 112 in peristaltic pump assembly 100. When assembled, tubing extends from the interior of container 30 to peristaltic pump assembly 100 such that rotation of pump lever 145 and the resultant rotation of roller assembly 112 results in withdrawal of material from container 30 and dispensing of the desired amount of material.

Peristaltic pump assembly 100 is preferably provided with either three or four rollers 117 in order to provide users with varying levels of precise dosing, as well as oxygen and bacteria barriers to prevent migration of bacteria back into container 30. The peristaltic pump is configured such that the greater the number of rollers provided the shorter the stroke that is required to dispense a portion of product from container 30. Further, the handle stroke, particular thickness of tubing extending from container 30 to peristaltic pump assembly 100, and number of rollers on peristaltic pump assembly 100 may be varied and optimized to provide the necessary dosing for any given application.

In operation of the portion control dispenser depicted in FIG. 1, a container 30 is attached to mount 70 with the exterior roller 20 rotated away from interior roller 21. The weight of a full container causes the carriage assembly 40 to be fully lowered. Exterior roller is closed over the end of container 30 and latched in place by plunger 22, thereby pinching container 30 between interior roller 21 and exterior roller 20. As a user depresses the pump lever 145 of the peristaltic pump assembly 100, a controlled amount of product is dispensed. As more product is dispensed, the resistance provided by product in container 30 against rollers 20 and 21 is lessened, enabling the carriage assembly 40 to be raised and drawing container 30 between the rollers 20 and 21 during its upward travel. Such action aids gravity by continuously directing all remaining product in the container 30 toward the dispensing end, in turn minimizing waste that results from undispensed product.

In the particular embodiment of the instant invention depicted in FIG. 1, the dispensing apparatus is shown with carriage 40 at the top of its stroke. At such final position, it can be seen that rollers 20 and 21 have flattened container 30 as it has been drawn upward between the rollers so as to continuously direct all material therein towards the bottom of container 30. This ensures dispensing of the entire content of container 30, thus minimizing or altogether eliminating waste associated with prior art dispensing devices. Moreover, the construction of the portion control dispenser of the instant invention enables the entire volume of product stored within container 30 to be kept sterile until dispensed.

It will be appreciated by persons skilled in the art that numerous variations and/or modifications may be made to the invention as shown in the specific embodiments without departing from the spirit or scope of the invention as broadly described. Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It should be understood, therefore, that the invention may be practiced otherwise than as specifically set forth herein. The present embodiments are, therefore, to be considered in all respects as illustrative and not restrictive.

While specific values, relationships, materials and steps have been set forth for purposes of describing concepts of the invention, it should be recognized that, in the light of the above teachings, those skilled in the art can modify those specifics without departing from basic concepts and operating principles of the invention taught herein.

What is claimed is:

1. An apparatus for dispensing a portion of material from a flexible container, comprising:

an extrusion assembly;

a moveable carriage, said moveable carriage further comprising a mount configured to hold an end of a flexible container, said moveable carriage being positioned with respect to said extrusion assembly so as to draw a flexible container mounted to said mount through said extrusion assembly when said moveable carriage is moved away from said extrusion assembly;

a spring biasing said moveable carriage away from said extrusion assembly; and a dispensing pump positioned for fluid communication with a flexible container mounted to said mount, said dispensing pump being configured to dispense a predetermined volume upon a single operation of said dispensing pump.

2. The apparatus of claim 1, said dispensing pump further comprising a manually operable actuator, and said dispensing pump having a stroke defined by a single operation of said manually operable actuator, said dispensing pump being operable to dispense said predetermined volume upon such single operation of said manually operable actuator.

3. The apparatus of claim 2, wherein said extrusion assembly is configured to provide sufficient resistance against said spring to prevent movement of said moveable carriage away from said extrusion assembly, and wherein said single operation of said manually operable actuator temporarily reduces said resistance so as to enable said moveable carriage to move an incremental distance away from said extrusion assembly.

4. The apparatus of claim 1, wherein said extrusion assembly is configured to provide sufficient resistance against said spring to prevent movement of said moveable carriage away from said extrusion assembly, and wherein said single operation of said dispensing pump temporarily reduces said resistance so as to enable said moveable carriage to move an incremental distance away from said extrusion assembly.

5. The apparatus of claim 1, said dispensing pump further comprising a peristaltic pump.

6. The apparatus of claim 5, wherein said peristaltic pump is manually operable.

7. The apparatus of claim 6, said peristaltic pump further comprising a manually operable actuator, and said peristaltic pump having a stroke defined by a single operation of said manually operable actuator, said peristaltic pump being operable to dispense said predetermined volume upon such single operation of said manually operable actuator.

8. The apparatus of claim 1, said extrusion apparatus further comprising at least one roller positioned to apply a compressive force against a flexible bag mounted to said mount.

9. The apparatus of claim 1, said extrusion apparatus further comprising a pair of rollers positioned such that a flexible bag mounted to said mount will be drawn between said pair of rollers as said moveable carriage moves away from said pair of rollers, said pair of rollers being positioned with respect to one another so as to apply a compressive force against such a flexible bag mounted to said mount and positioned therebetween.

10. The apparatus of claim 9, further comprising means for biasing said rollers toward one another.

11. The apparatus of claim 10, said biasing means further comprising springs.

12. The apparatus of claim 1, said spring further comprising a constant force spring.

13. An apparatus for dispensing a portion of material from a flexible container, comprising:

a frame;

an extrusion assembly mounted to said frame;

a carriage moveably mounted to said frame, said moveable carriage further comprising a mount configured to hold an end of a flexible container;

a flexible container having a first end held by said mount and a second end opposite said first end, and a material therein;

a spring biasing said moveable carriage away from said extrusion assembly; and a dispensing pump in fluid communication with said flexible container, said dispensing pump being configured to dispense a predetermined volume of material from said flexible container upon a single operation of said dispensing pump;

wherein said movable carriage is positioned with respect to said extrusion assembly so as to draw said flexible container through said extrusion assembly when said moveable carriage is moved away from said extrusion assembly.

14. The apparatus of claim 13, said dispensing pump further comprising a manually operable actuator, and said dispensing pump having a stroke defined by a single operation of said manually operable actuator, said dispensing pump being operable to dispense said predetermined volume upon such single operation of said manually operable actuator.

15. The apparatus of claim 14, wherein said extrusion assembly is configured to provide sufficient resistance against said spring to prevent movement of a filled portion of said flexible container through said extrusion assembly, and wherein said single operation of said manually operable actuator removes said predetermined volume of material from said filled portion of said flexible container so as to enable said moveable carriage to move an incremental distance away from said extrusion assembly.

16. The apparatus of claim 13, wherein said extrusion assembly is configured to provide sufficient resistance against said spring to prevent movement of a filled portion of said flexible container through said extrusion assembly, and wherein said single operation of said dispensing pump removes said predetermined volume of material from said filled portion of said flexible container so as to enable said moveable carriage to move an incremental distance away from said extrusion assembly.

17. The apparatus of claim 13, said dispensing pump further comprising a peristaltic pump.

18. The apparatus of claim 17, wherein said peristaltic pump is manually operable.

19. The apparatus of claim 18, said peristaltic pump further comprising a manually operable actuator, and said peristaltic pump having a stroke defined by a single operation of said manually operable actuator, said peristaltic pump being operable to dispense said predetermined volume of material upon such single operation of said manually operable actuator.

20. The apparatus of claim 13, said extrusion apparatus further comprising at least one roller, said roller applying a compressive force against said flexible bag.

21. The apparatus of claim 13, said extrusion apparatus further comprising a pair of rollers positioned such that said flexible bag is drawn between said pair of rollers as said moveable carriage moves away from said pair of rollers, said pair of rollers being positioned with respect to one another so as to apply a compressive force against said flexible bag.

22. The apparatus of claim 21, further comprising means for biasing said rollers toward one another.

23. The apparatus of claim 22, said biasing means further comprising springs.

24. The apparatus of claim 13, said spring further comprising a constant force spring.

* * * * *